United States Patent [19]

Allen

[11] Patent Number: 4,973,993

[45] Date of Patent: Nov. 27, 1990

[54] INK-QUANTITY AND LOW INK SENSING FOR INK-JET PRINTERS

[75] Inventor: Ross R. Allen, San Diego, Calif.

[73] Assignee: Hewlett-Packard Company, Palo Alto, Calif.

[21] Appl. No.: 378,354

[22] Filed: Jul. 11, 1989

[51] Int. Cl.[5] ..... B41J 2/175

[52] U.S. Cl. ..... 346/140 R; 346/1.1

[58] Field of Search ..... 346/75, 140 PD, 1.1

[56] References Cited

U.S. PATENT DOCUMENTS 4,342,042 7/1982 Cruz-Uribe et al. ..... 346/140 PD

*Primary Examiner*—George H. Miller, Jr.

[57] ABSTRACT

For an ink-jet printer, an indication of the quantity of ink remaining gives the user useful information about when to replace a disposable printhead or ink cartridge. The invention disclosed herein provides a means for computing remaining ink and for sensing a true low-ink and out-of-ink condition. Ink is supplied to a printhead (24) by an elastic bladder (16) which is periodically refilled from an ink bag (14). The bladder is designed to collapse in a repeatable manner as ink is consumed. A sensor probe (100), which moves along the bladder's collapse axis, dimples the bladder prior to printing to initialize the collapse mode. The probe position along the axis is measured when its sensitive tip (102) touches the bladder. The difference between bladder positions before and after refill is used in an algorithm to compute the bladder's volumetric change. This is the ink consumed on each print cycle, and gives the quantity of ink remaining when subtracted from an initial value. The bladder's position is known when it refills completely, but it will not reach this position when the ink bag fully collapses from ink exhaustion. Sensing that the bladder has not extended to the full position after a refill cycle produces the true low-ink and out-of-ink indication.

17 Claims, 5 Drawing Sheets

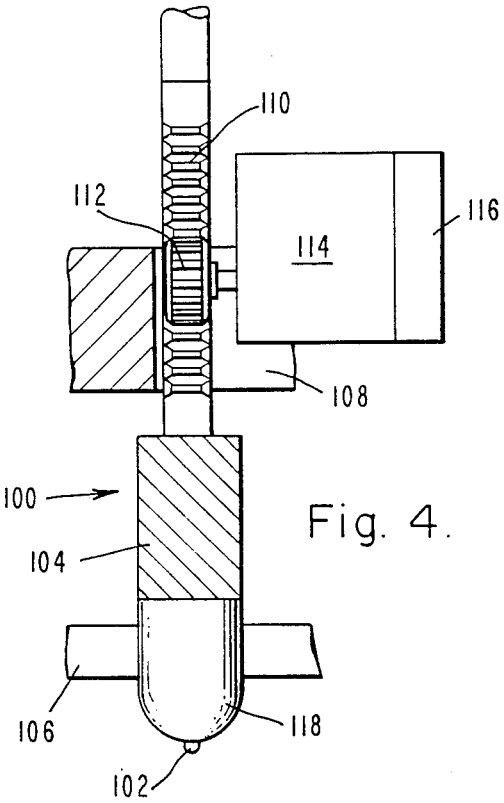
Fig. 4.
Fig. 5.
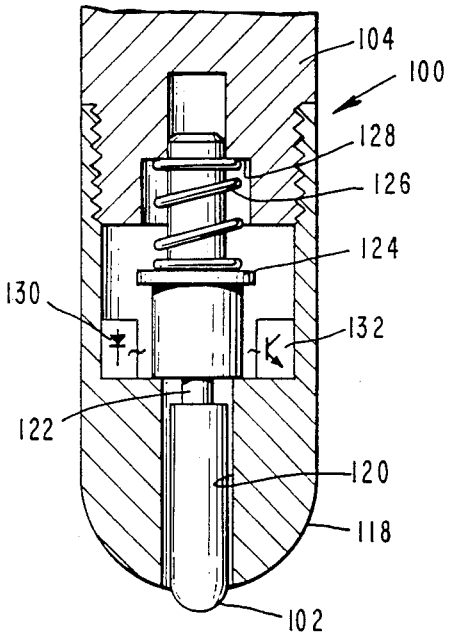
Fig. 7.
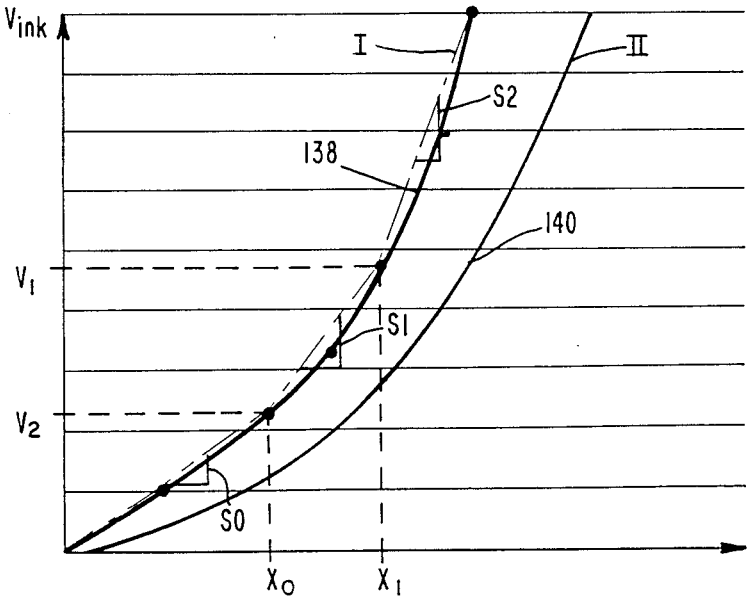

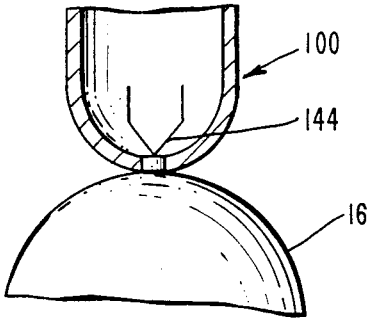
Fig. 8.
Fig. 9.
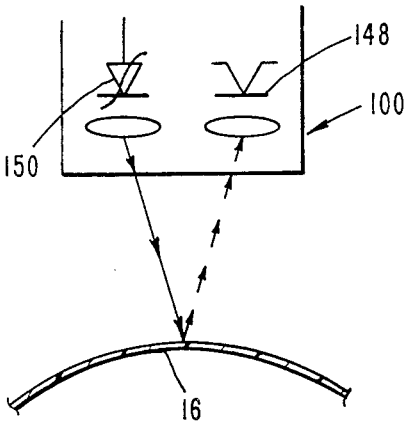
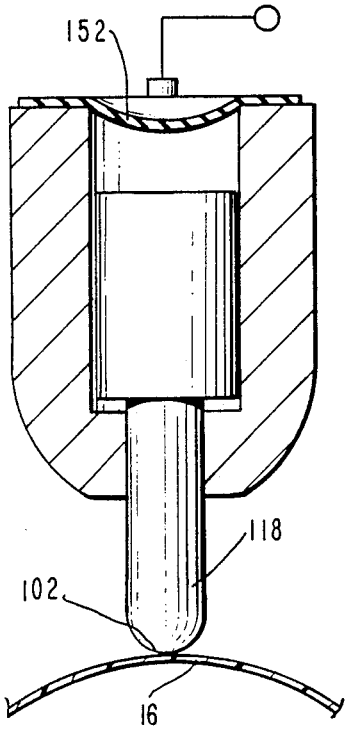
Fig. 10.

INK-QUANTITY AND LOW INK SENSING FOR INK-JET PRINTERS

TECHNICAL FIELD

This invention relates to ink-jet printers and to ink cartridges used therein. More particularly, this invention relates to sensing of the quantity of ink in an elastic ink bladder which is periodically refilled from an ink bag.

BACKGROUND ART

Ink-jet printheads employed in ink-jet plotters consume considerable quantities of ink. Such quantities require a means for storing sufficient ink for the useful life of the printhead. Further, ink must be supplied to the printhead under a prescribed negative pressure to prevent ink from dripping out of the nozzles. The word "ink" in this application means any liquid toner which is deposited on demand onto a recording medium.

An ink delivery system has been developed which is provided with a reservoir for supplying a refillable bladder. The bladder is then used to feed the printhead, and when the bladder is depleted, it is refilled from the reservoir, or ink bag. This ink delivery system is the subject of a separate patent, U.S. Pat. No. 4,714,937, issued on Dec. 22, 1987, and assigned to the assignee of the present application. In that system, a refillable bladder, a valve and an ink bag are utilized to deliver ink to the ink-jet printhead. The valve permits selective fluid communication between the ink bag and the bladder (refill mode) and between the bladder and the ink-jet printhead (print mode). A third position (shipping mode) prevents fluid communication between any of the components.

For an ink-jet printer incorporating a bladder, whether refillable, as above, or non-refillable, an indication of the quantity of ink remaining would give the user useful information about when to replace a disposable printhead or ink cartridge. Further, such an indication is important in determining when to actuate the valve to refill a refillable bladder from the reservoir.

Several means of sensing ink quantity and a low-ink condition are known in the art. These means include liquid level sensing in a fluid ink chamber by means of floats, optical probes, thermistors, conductivity sensors, and pressure probes. Capacitive sensing is sometimes used to determine the spacing between walls of a collapsing ink bag.

However, such prior art approaches suffer from a variety of deficiencies. Many are expensive per se, or require the addition of expensive components. Other prior art sensors are included as part of the disposable consumables. Still other sensors are intended to rely on the physical properties of inks, such as color or optical density, chemical composition, reactivity, mass density, viscosity or electrical conductivity, and are therefore limited in versatility.

Depending on a particular configuration, the prior art sensors may be subject to significant errors in determining the remaining ink level or reliably detecting a true out-of-ink condition if they do not actually sense ink quantity but rely upon indirect means, such as conductivity, capacitance, optical density, etc.

Thus, there remains a need to provide a means for sensing ink-quantity and low-ink condition in ink-jet printers which avoids most, if not all, of the foregoing limitations.

DISCLOSURE OF INVENTION

Accordingly, it is an advantage of the present invention that it provides a means for sensing ink-quantity and low-ink condition in ink-jet printers that is low cost, requires a minimum of additional components and involves no additional components that are part of disposable consumables.

It is another advantage of the present invention that it provides a sensing means that is independent of the physical properties of the ink and thus can be used in a variety of ink-jet printers using any color or formulation of ink.

It is a still further advantage of the present invention that it provides a sensing means that may be used with any number of ink cartridges employed in a variety of ink-jet printers suited to different applications such as black and color text and graphics and in various formats from standard office paper ($8\frac{1}{2} \times 11$; A4-size) to special forms and large format (A0–A3 size).

It is yet another advantage of the present invention in that it provides a new, simplified ink delivery system which also can use the sensing means of this invention.

These and further advantages will become more readily apparent upon a consideration of the appended drawings taken in conjunction with the following commentary.

Briefly, a means for sensing ink-quantity and low-ink condition in an ink delivery system employed in ink-jet printers is provided. The sensing means comprises a sensor probe, which is adapted to be used with an ink delivery system including (1) a printhead adapted to propel droplets of ink onto a recording medium and (2) a deformable enclosure, or bladder means, for storing liquid toner, or ink, and supplying a quantity of the liquid toner at a prescribed pressure to the printhead.

In accordance with the invention, the sensor probe comprises:

(a) means for moving the sensor probe into and out of contact or proximity with the surface of the bladder means;

(b) means for sensing contact or proximity of the sensor probe to the surface of the bladder means;

(c) means for determining the position of the sensor probe when contact or proximity to the surface of the bladder means is established; and (d) means for converting the position of the sensor probe when contact or proximity to the surface of the bladder means is established into a measurement of ink quantity remaining in the bladder, taking into account the volume-deflection characteristic of the bladder means.

The quantity of ink in the bladder as well as detecting a low-ink or out-of-ink condition is determined by (1) moving the sensor probe to initially contact a full bladder, (2) deforming the bladder to form a dimple therein to initiate ink delivery for the print cycle, (3) contacting the bladder at the end of the print cycle, and (4) again contacting the bladder after refilling with ink and noting the location of each of these positions with respect to a reference position. Algorithms are provided for determining the quantity of ink in the bladder, as well as sensing low-ink or out-of-ink conditions.

The sensor of the invention is low in cost, requiring a minimum of additional inexpensive components to be added to a mechanism already part of an ink delivery system to dimple the bladder; it involves no additional components which are part of disposable consumables; it provides both an accurate prediction of the quantity of ink remaining after each bladder refill, and senses a true low-ink condition; and it works with all inks independent of their physical properties such as color, chemical composition and reactivity, density, viscosity, and electrical conductivity. In a multi-color ink-jet printer, a single sensor probe of the invention can be used for different colors merely by positioning it over each color's ink bladder during the refill cycle.

BRIEF DESCRIPTION OF THE DRAWINGS

FIG. 4 is a front elevational view of a sensor probe of the invention.

FIG. 5 is a cross-sectional view of an enlarged portion of the sensor probe depicted in FIG. 4.

FIG. 7 is a plot on axes of volume of ink delivered and the difference in axial position of the bladder surface at the end and beginning of the write cycle, and represents the quantity of ink consumed during the print cycle.

FIG. 8 is a diagrammatic view of an alternative embodiment of the sensor probe of the invention, depicting a thermistor sensor.

FIG. 9 is a diagrammatic view of another alternative embodiment of the sensor probe of the invention, depicting a photoreceptor/photoreceiver pair.

FIG. 10 is a diagrammatic view of yet another alternative embodiment of the sensor probe of the invention, depicting a flexible membrane switch in combination with a dimpler.

BEST MODES FOR CARRYING OUT THE INVENTION

Figure 1:
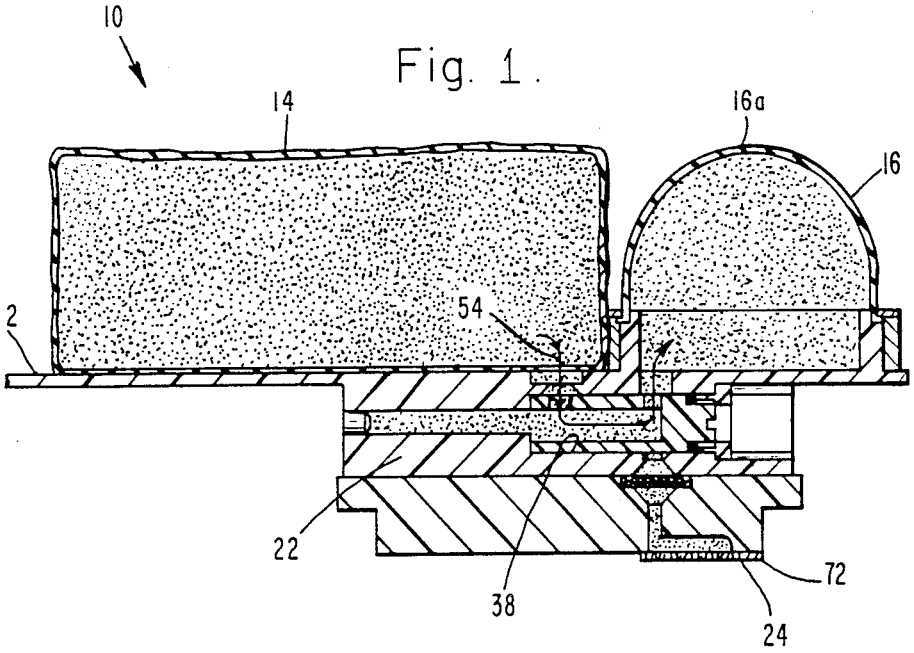
FIG. 1 is a longitudinal cross-sectional view of the ink delivery, system of U.S. Pat. No. 4,714,937.

Referring now to the drawings wherein like numerals of reference designate like elements throughout, an ink delivery system of U.S. Pat. No. 4,714,937 is depicted in FIG. 1 generally at 10. The ink delivery system or apparatus 10 comprises a support platform 12, which supports an ink bag 14 and a bladder 16 on a first major surface thereof. A cover (not shown) may be utilized to provide protection for the bladder 16 or for the bladder and ink bag 14. The cover desirably has an opening positioned over the bladder 16 for providing access to the top surface 16*a* of the bladder, so that a probe may dimple the bladder.

On the opposite major surface of the platform 12 is a valve body 22 and an ink-jet printhead 24. The valve body 22 contains fluid passages and sealing surfaces to permit selective fluid flow from ink bag 14 to bladder 16, and from bladder 16 to printhead 24. In the alternative, fluid flow may be completely cut off.

In FIG. 1, valve body 22 is shown in the bladder refill mode. In this position, there is no fluid communication between the bladder 16 and printhead 24. However, there is fluid communication between ink bag 14 and bladder 16.

The ink delivery system is intended for use with ink-jet printers for office and design graphics applications, covering a wide range of paper sizes, various printers, and various colors and formulations of inks. The presence of the ink bag 14 permits several refills of the bladder 16, thereby enabling more extended use of the printhead 24 (which is capable of any more print cycles than provided by the size of the bladder 16).

The ink bag 14 gradually collapses as its contents are transferred to the bladder 16. The bladder, on the other hand, comprising a resilient material, may be refilled several times from the ink bag. The refill of the bladder is automatic once it is connected by the valve body 22 to the ink bag 14. No pump is required, with the negative pressure for drawing ink out of the bag 14 being produced by bladder elasticity.

Figure 2:
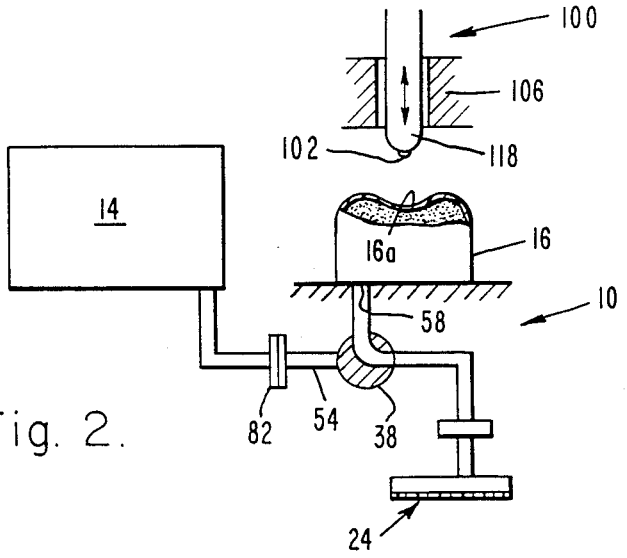
FIG. 2 is a schematic diagram of a generic ink delivery system comprising a refillable ink bladder, an ink bag, and a valve, in cooperative association with an ink sensing means above the bladder.

In a disposable ink-jet printing cartridge, the ink bag 14, bladder 16, printhead 24 and associated components are assembled into a self-contained unit and disposed of together. In an ink-jet printing system with a permanent printhead, fluidic interconnect 82, shown schematically in fluid line 54 (FIG. 2), permits the ink bag 14 to be replaced when empty, leaving the other elements as permanent (or service-replaceable) components of the printer.

The ink bladder 16 is so designed that it collapses in an axisymmetric or otherwise repeatable manner as ink is consumed by ink-jet printhead 24.

Figure 3:
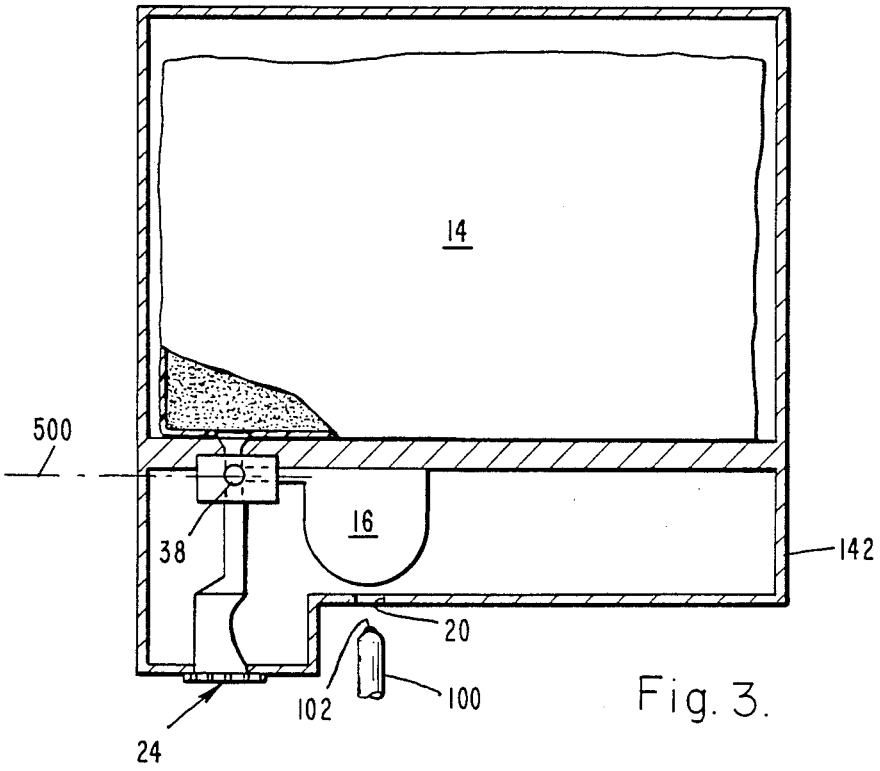
FIG. 3 is a schematic diagram of an alternative ink delivery system in which the refillable ink bladder is located at a lower level than the ink bag and the ink sensing means is below the bladder.

Another system is schematically presented in FIG. 3. In this embodiment, bladder 16 is located below ink bag 14. Three-way valve 38 is preferably a substantially cylindrical, solid body with substantially a right angle channel therein. The channel is designed so that, in one arrangement, one of its outlets communicates with an ink supply from ink bag 14 while the other outlet communicates with bladder 16. In this arrangement, bladder 16 is dimpled at the bottom by sensor probe 100, which enters cover 142 through hole 20. This causes a small amount of ink and any air that may be in bladder 16 to flow back into ink bag 14. By rotating valve 38 ninety degrees clockwise about axis 500, the channel is now aligned to allow ink to flow from bladder 16 to printhead 24. When ink is ejected from printhead 24, it act like a pump and pulls ink out of bladder 16. Valve 38 can also be rotated so that channel outlets are not in communication with ink supply from ink bag 14, or bladder 16, in which case the flow of ink is completely cut off.

In accordance with one aspect of the invention, a sensor probe, shown generally at 100 in FIG. 4, is provided for determining the quantity of ink in the bladder 16 and for sensing a low ink level therein. The probe 100 comprises two major subassemblies: sensor tip 102 and probe body 104. Probe body 104 slides within guides 106, 108 along the axis of collapse of bladder 16. Guide 106 may comprise the dimpler hole (for example, hole 20 in FIG. 3) in the protective cover discussed earlier or, preferably, part of a separate assembly.

In a preferred embodiment, linear motion of probe 100 is produced by rack 110 and pinion gear 112, which are driven by gear motor 114. Rack 110 forms the upper portion of probe body subassembly 104. Processing of the signal from encoder 116 on the gear motor 114, taking into account gear ratios and the pitch diameter of the pinion gear 112, gives the position of the tip 102 of the probe 100. Other schemes providing a measurable translation of probe body 104 are considered within the scope of this invention.

The position of sensor tip 102 locates the bladder's upper surface 16*a* in FIGS. 2 and 6*a–d* for ink quantity measurements and is used to control the position of the probe 100 when deforming the bladder 16 prior to the print cycle. Other linear and rotary motion mechanisms are known in the art for moving probe 100 along the axis of collapse of ink bladder 16 and may be suitable for implementation of this invention.

FIG. 5 is a cross-sectional view of the sensor tip 102 of the probe 100, showing details of a preferred embodiment of the bladder-contact sensor. The sensor comprises a cylindrical rod 118 which is free to slide along the probe axis within guides 120. Rod 118 has a notch 122 and flange 124. The flange 124 provides one seat for a compression spring 126. Land 128 in the probe body 104 forms the other seat for the spring 126. The spring 126 is preloaded such that the rod 118 normally extends approximately 1 mm beyond the tip 102. The tip 102 may be shaped so as to introduce an appropriate initial deformation or dimpling of the bladder 16 prior to the beginning of the print cycle. The stiffness of the spring 126 is chosen such that the force exerted by the probe 100 on the bladder 16 to deform it as described above is sufficient to cause the rod 118 to retract into the tip 102. The spring 126 must also provide sufficient force to overcome any sliding friction or binding forces between the rod 118 and guides 120 so that the rod 118 may be extended out of the tip 102 when not in contact with the bladder 16.

Should an adhesive characteristic of the material comprising the bladder 16 prove problematical, the sensor tip 102 and the rod 118 may comprise a material which freely releases from contact with the bladder 16. Examples of such materials include polytetrafluoroethylene and nylon, although other materials having the requisite properties may also be employed.

Figures 6A, 6B, 6C, 6D:
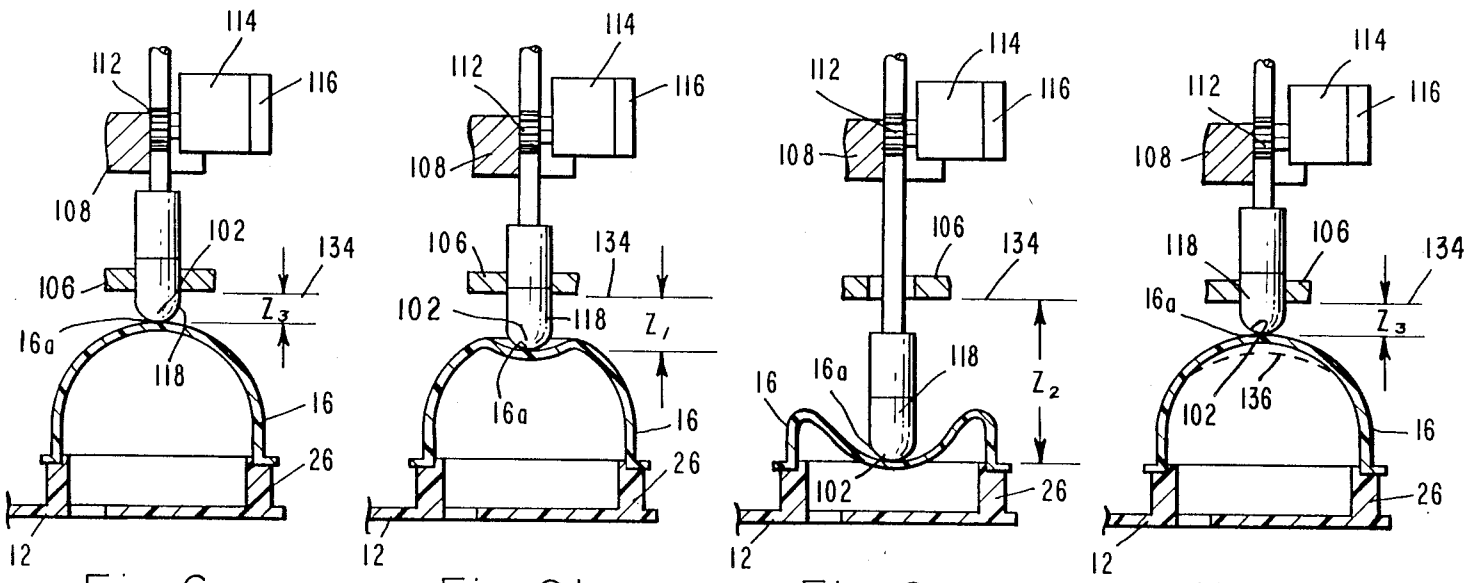
FIGS. 6*a–d* are front elevational views of a sensor probe of the invention in cooperative association with the ink bladder and depict the various stages of sensing of ink quantity and low-ink condition.

The position of the rod 118 determines if the probe 100 is in contact with the undeformed top surface 16*a* of the bladder 16, as shown in FIG. 6*a*. The position is sensed using a matched light-emitting diode (LED) 130 and phototransistor 132 pair. Normally, the extension of the rod 118 outside of the tip 102 blocks the optical path between the LED 130 and the transistor 132. However, when the rod 118 is forced back into the tip 102 by contact with the bladder 16, the cutout or notch 122 in the rod 118 opens the optical path, thereby allowing the LED 130 to illuminate the phototransistor 132. The illumination of the phototransistor 132 can be sensed by placing it in an appropriate electronic circuit well-known in the art. Further, the power supplied to the LED 130 and phototransistor 132 may be accomplished by circuit means well-known in the art by means of a cable and interconnect (not shown) with probe body 104 or indirectly to LED 130 and phototransistor 132.

Below a first preset illumination value, the rod 118 and probe 100 are considered not in contact with the bladder 16. This value is used to measure the position of the bladder 16. Above a second preset illumination value, the rod 118 and probe 100 are considered to be in contact with the bladder 16. This value is used to position the probe 100 to produce the initial deformation or dimpling of the bladder 16 prior to beginning a print cycle.

For refilling the bladder 16 and deforming it to the initial state for ink delivery shown in FIG. 6*b*, valve body 22 is positioned as shown in FIG. 1 so as to fluidically interconnect bladder 16 to ink bag 14 while fluidically isolating ink-jet printhead 24. This allows freeflow of ink between the bladder 16 and the ink bag 14 without creating pressure disturbances at the ink-jet printhead 24 which could force ink out or pull air into the ink-jet printhead nozzles 70.

The probe 100, which slides within guides 106 along the axis of collapse of the bladder 16, deforms the bladder to the position shown in FIG. 6*b*. Valve body 22 is then rotated so that the bladder 16 is fluidically connected to the ink-jet print head 24 while the ink bag 14 is fluidically isolated. The negative gauge pressure at the ink-jet printhead nozzles 70 prevents ink from flowing out of the nozzles under the influence of gravity. The positive pressure head produced when the ink bag 14 is positioned above the nozzles 70 is at all times isolated from the nozzles bY the valve rotor 38.

The probe 100 is retracted, and elastic stress in the bladder 16 produces a negative gauge pressure at the nozzles 70 in the ink-jet printhead 24. The axial position of the probe 100 is measured with respect to datum 134 when contact with the bladder 16 is terminated. This is position "$Z_1$" in FIG. 6*b*, where $Z_1$ has a nominal value Z1.

During the print cycle, the bladder 16 delivers ink to the ink-jet printhead 24 and collapses as shown in FIG. 6*c*. Logic in the printer estimates the ink consumed to ensure that bladder deflection does not exceed the limit defined by the usable delivery volume. This can be done by processing data in the printer's scan buffer to count ink drops printed since the last bladder refill.

At the end of the print cycle, the probe 100 slides along the bladder collapse axis until it contacts the bladder surface 16*a*. The probe 100 is then retracted, and its position with respect to datum 134 is measured when contact is terminated with the bladder 16. This is position "$Z_2$" in FIG. 6*c*.

The bladder 16 is now refilled by actuating valve rotor 38 to the position shown in FIGS. 1, which fluidically connects the bladder 16 to the ink bag 14. Elastic stress in the bladder 16 causes it to return to the fully-extended, undeformed position shown in FIG. 6*d* (see also FIG. 6*a*). In so doing, it draws ink from the bag 14 and refills automatically without the aid of a pump or external pressure source, as discussed above.

The ink bag 14 typically stores a volume of ink ten to one hundred times the usable delivery volume of the bladder 16. Thus, the bladder 16 will refill many times during the service life of a single ink bag 14. Until all the usable volume of ink is withdrawn, the ink bag 14 is designed to collapse without producing significant back pressure from elastic forces. This allows the bladder 16 to refill freely from the ink bag 14. However, when the ink bag 14 is exhausted, it produces a hydraulic lock, preventing full extension of refilling bladder 16. This feature is essential to sensing a true low-ink situation.

The probe 100 is extended to contact the surface of the bladder 16 after sufficient time has passed for it to refill (typically about 3 to 5 seconds). The probe 100 is then removed and its position is measured with respect to datum 134 when contact is terminated. This is position "$Z_3$" in FIG. 6*d*.

In the case of ink exhaustion, the bladder 16 cannot fully retract and its upper surface 16*a* assumes a position such as that indicated by the dotted line 136 in FIG. 6*d*.

Position measurements $Z_1$, $Z_2$, and $Z_3$ are used to determine the quantity of ink consumed and to detect a low-ink condition. It will be appreciated from a study of FIGS. 6b–d that $Z_3<Z_1<Z_2$ always, so the arithmetic differences in the following discussion are always positive-definite.

FIG. 7 shows a typical experimental relation between delivered ink volume from the bladder 16 and the difference in axial positions, $Z_2-Z_1$, of the upper bladder surface 16a at the end and the beginning of the print cycle, respectively. Curve 138 represents the average performance of a group of nominally-identical bladders. An analytical representation of curve 138 is used in a computational algorithm to give the volume of ink, $V_{ink}$, in terms of $Z_2-Z_1$.

Let $$x=Z_2-Z_1$$

$V_{ink}$=delivered ink volume $s_0$, $s_1$, $s_2$=slopes in curve 138.

Curve 142 represents a three-part, piece-wise linear fit to experimental data. Using this scheme, $$V_{ink}=\begin{cases} s_0x: 0 \leqq x < x_0 \\ v_0+s_1(x-x_0): x_0 \leqq x < x_1 \\ v_1+s_2(x-x_1): x_1 \leqq x \end{cases}$$

where $S_{0,l}$, and $S_2$ are slopes of the piece-wise linear function and $V_0$ and $v_1$ are values at the slope breakpoints.

Curve 140 represents a polynominal fit to experimental data:

$$V_{ink}=a+bx+cx^2 \text{ (2nd-order fit)},$$

where a, b, and c are constants. The differences between the curves have been exaggerated for clarity.

The quantity of usable ink remaining at the end of the print cycle is the remaining usable ink at the beginning of the print cycle minus the volume change of the bladder 16 from the curve 138 representing the ink consumed during the print cycle. The initial value is the usable quantity stored in the ink bag 14 after the bladder 16 is deformed prior to beginning the first print cycle. If the bladder 16 is full of ink prior to first use, this accounts for some ink stored in the fully-extended bladder 16 during shipping which is transferred to the ink bag 14. The datum for a full usable quantity of ink in the bladder 16 is always the nominal deformed state (FIG. 6b).

These calculations are performed in the printer's arithmetic and control unit. The value representing the quantity of ink remaining can be stored in non-volatile memory for each ink-jet printhead 24 in a single- or multi-color ink-jet printer.

The true low-ink condition sensed directly in accordance with this invention is inherently more reliable than one based on the computed quantity of ink remaining described above: no accumulated uncertainties are present. A true low-ink condition is found by comparing the measured position, $Z_3$, for the present refill cycle with the nominal value determined from previous measurements of a known fully refilled bladder. This permits accommodation of a tolerance on the bladder's absolute position in the machine.

The arithmetic difference, $D=Z_3-Z3$, is computed, and one of three situations is determined from the result:

$-e<D<e$: The bladder has fully extended and completely refilled. "e" is a constant representing a tolerance value on the repeatability of measurements.

$D<(Z1-Z3)$: The bladder has not fully extended, but its equilibrium position is less deformed than required to begin the print cycle. It can be deformed further to begin a new print cycle with a full usable charge. The exhaustion of the ink bag 14 has been sensed. This is a "LOW-INK" situation, but the print cycle can continue to completion.

$D>(Z1-Z3)$: The bladder has not fully extended as far as the initial deformation at the beginning of the print cycle (FIG. 6b). Therefore, it cannot begin a print cycle with a full usable charge. This is an "OUT-OF-INK" situation which may be used to take the printer off-line to prevent loss of data.

Another contacting sensor probe is shown in FIG. 8. There, the sensor probe, denoted generally at 100, comprises a thermistor sensor 144. In this embodiment, the thermistor is operated in a self-heating mode by application of an electric current sufficient to raise the thermistor's temperature a few degrees above the ambient temperature. At this point, a certain resistance value will be measured by electric circuitry well-known in the art. Upon contact with the bladder, heat will be conducted out of the warm thermistor into the cooler bladder, thus lowering the thermistor's temperature. The associated change in resistivity may be measured and used to determine proximity of the bladder and sensor.

The sensor probe need not contact the surface of the bladder 16. Dimpling may be done by a separate dimpler rod 118, such as shown in FIG. 10. Sensing may be done by a proximity measurement, such as using as the sensing probe 100 a photoreceptor 148 and a photoemitter 150 pair arranged such that light emitted by the photoemitter 150 will be received by the photoreceptor 148 only when a surface reflecting the emitted light is placed within a prescribed distance or range of distances from the photo-receptor-emitter pair. This proximity measuring scheme is depicted in FIG. 9.

A further implementation, shown in FIG. 10, consists of a membrane-type switch or microswitch 152 actuated by the slider, or dimpler, rod 118 depicted in FIG. 5. Other implementations which accomplish the same result are also contemplated as being within the scope of the invention.

The bladder 16 is formed with a suitably reflective surface, which may be done either by use of a reflective material to form the bladder or by application of a reflective portion consisting of an adhesive-backed reflective tape subsequent to making the bladder.

The foregoing is a detailed description of one form of a disposable printing cartridge. However, it will be appreciated that, as briefly described above, other configurations of disposable cartridges are contemplated by the invention. For example, the ink bag 14 itself may be replaceable, employing a needle and septum or other fluid communication system. Further, the ink bag 14 may be located in the printer itself, away from the platform 12, but connected thereto by a suitable tube and fluid communication means. In all cases, the sensor 100 of the invention is associated with the ink bladder 16, regardless of the particular configuration of the ink delivery system and the location of the ink bag 14.

INDUSTRIAL APPLICABILITY

The sensor probe of the invention is useful in ink delivery systems employing a refillable ink bladder, used in ink-jet printers. The sensor probe permits accurate measurement of the consumption of ink in the ink-jet printer on each bladder refill cycle, and the measurements of the consumed quantity of ink may be accumulated and subtracted from the initial quantity to give an indication of the quantity of ink remaining. The sensor probe also provides a true low-ink and out-of-ink indication independent of the measurement of ink consumed. The invention may be used both with disposable printing cartridges, such as a self-contained unit consisting of an ink supply and printhead, or with a permanent or replaceable printhead which is supplied with ink from disposable cartridges.

Thus, a sensor probe for sensing ink-quantity and low-ink condition for ink-jet printers has been provided. Various changes and modifications will be apparent to those of ordinary skill in the art, and all such changes and modifications are considered to fall within the spirit and scope of the invention, as defined by the appended claims.

What is claimed is:

1. A sensor probe for sensing ink quantity and low-ink condition in an ink delivery system employed in an ink-jet printer, said ink delivery system including (1) a printhead adapted to propel droplets of ink onto a recording medium, and (2) a deformable enclosure for storing liquid toner and delivering a quantity of said liquid toner at a prescribed pressure to said printhead, said sensor probe comprising:

(a) means for moving said sensor probe into and out of contact or proximity with the surface of said deformable enclosure;

(b) means for sensing contact or proximity of said sensor probe to said surface of said deformable enclosure;

(c) means for determining the position of said sensor probe when contact or proximity to said surface of said deformable enclosure is established; and (d) means for converting said position of said sensor probe when contact or proximity to said surface of said deformable enclosure is established into a measurement of ink quantity remaining in said deformable enclosure, taking into account the volume-deflection characteristic of said deformable enclosure.

2. The sensor probe of claim 1 wherein said ink delivery system further includes an ink storage reservoir for refilling said deformable enclosure at least once.

3. The sensor probe of claim 1 wherein said sensor probe includes a contacting means to determine said position of said surface of said deformable enclosure, said contacting means comprising a body adapted to slide along a sensor axis by guides interior to said sensor body, said body being provided with a notch and a flange, said flange providing one seat for a compression spring and the interior of said body having a land therein for providing the other seat for said compression spring, said compression spring being preloaded to cause said sensor to extend partially beyond said lower portion of said sensor body and having a stiffness such that the force exerted by said sensor probe on said deformable enclosure to deform said deformable enclosure is sufficient to cause said body to retract within said lower portion of said sensor body, and a light source and detection means provided on opposite sides of said body, positioned such that in its normal extended position, said body blocks passage of light therebetween and in its retracted position, said notch of said body permits passage of light therebetween.

4. The sensor probe of claim 3 wherein said light source and detection means comprise a light emitting diode and a phototransistor, respectively, together with associated power and detection circuitry.

5. The sensor probe of claim 1 wherein said sensor probe employs non-contacting means to determine said position of said surface of said deformable enclosure relative to said probe.

6. The sensor probe of claim 6 wherein said noncontacting means comprises:

(a) a photoreceptor and a photoemitter paired such that light emitted by said photoemitter will be received by said photoreceptor only when a surface reflecting said emitted light is placed within a certain prescribed distance or range of distances from said photo-receptor-emitter pair, thereby providing proximity detection means for a surface with respect to said sensor probe; and (b) said surface of said deformable enclosure adapted to reflect light from said photoemitter into said receptor.

7. A sensor probe for sensing ink quantity and low-ink condition in an ink delivery system employed in an ink jet system, said ink delivery system including (1) a printhead adapted to propel droplets of ink onto a recording medium, and (2) a deformable enclosure for storing liquid toner and delivering a quantity of said liquid toner at a prescribed pressure to said printhead, said sensor probe comprising:

(a) means for moving said sensor probe into and out of contact with the surface of said deformable enclosure;

(b) means for sensing contact of said sensor probe to said deformable enclosure, said means for sensing contact comprising a thermistor sensor located at the tip of said sensor probe and exposed to the same environment experienced by said tip of said probe, said thermistor sensor maintained in a self-heating mode by application of a sufficient electrical current to keep said thermistor sensor warmer than its surroundings, said thermistor sensor adapted to operate such that contact thereof with said surface of said deformable enclosure changes the thermal conductivity of said environment of said thermistor probe to thereby cause a measurable change in its electrical resistance from that when said probe is not in contact with said surface of said deformable enclosure;

(c) means for determining the position of said sensor probe when contact to said surface of said deformable enclosure is established; and (d) means for converting said position of said sensor probe when contact to said surface of said deformable enclosure is established into a measurement of ink quantity remaining in said deformable enclosure, taking into account the volume-deflection characteristic of said deformable enclosure.

8. The sensor probe of claim 7 said sensor probe comprises a dimpler rod for deforming said deformable enclosure and a membrane switch means for sensing such deformation.

9. The sensor probe of claim 7 wherein said sensor probe comprises a dimpler rod for deforming said deformable enclosure and a microswitch means for sensing said deformation.

10. A sensor probe for sensing ink quantity and low-ink condition in an ink delivery system employed in an ink-jet printer, said ink delivery system including (1) a reservoir for storing ink, (2) a printhead adapted to propel droplets of ink onto a recording medium, (3) a bladder means for supplying ink to said printhead and adapted to be refillable from said reservoir, and (4) means for providing selective fluid communication between said reservoir and said bladder and between said bladder and said printhead, said sensor probe comprising:

(a) an elongated sensor body having a hollow lower portion;

(b) means for moving said sensor body along its axis of elongation into and out of contact with an upper portion of said bladder, said axis substantially aligned with the collapse direction of said bladder;

(c) a sensor positioned in said lower portion of said sensor body and extending partially outward therefrom and adapted to translate along said axis in response to pressure contact with the top of said ink bladder; and (d) means for sensing inward movement of said sensor into said sensor body in response to said pressure contact.

11. The sensor probe of claim 10 wherein said means for moving said sensor body comprises a rack-and-pinion assembly, with said rack mounted on said sensor body and said pinion gear driven by a gear motor.

12. The sensor probe of claim 10 wherein said sensor body is adapted to slide between guides for preventing any substantial deviation from said axial movement.

13. The sensor probe of claim 10 wherein said sensor comprises a body adapted to slide along said sensor axis by guides interior to said sensor body, said body being provided with a notch and a flange, said flange providing one seat for a compression spring and the interior of said body having a land therein for providing the other seat for said compression spring, said compression spring being preloaded to cause said sensor to extend partially beyond said lower portion of said sensor body and having a stiffness such that the force exerted by said sensor probe on said bladder to deform said bladder is sufficient to cause said body to retract within said lower portion of said sensor body, and a light, source and detection means provided on opposite sides of said body, positioned such that in its normal extended position, said body blocks passage of light therebetween and in its retracted position, said notch of said body permits passage of light therebetween.

14. The sensor probe of claim 13 wherein said light source and detection means comprise a light emitting diode and a phototransistor, respectively, together with associated power and detection circuitry.

15. A method for sensing ink quantity in an ink delivery system employed in an ink-jet printer, said ink delivery system including (1) a printhead adapted to propel droplets of ink onto a recording medium, and (2) an ink bladder for supplying ink to said printhead, said method comprising:

(a) providing a sensor probe comprising (1) means for moving said sensor probe into and out of contact or proximity with the surface of said bladder, (2) means for sensing contact or proximity of said sensor probe with said bladder surface;

(b) establishing a null reference point;

(c) determining the position of said sensor probe relative to said null reference point when contact or proximity to said surface of said bladder is established;

(d) converting said position of said sensor probe when contact or proximity to said surface of said bladder is established into a measurement of ink quantity remaining in said bladder, taking into account the volume-deflection characteristic of said bladder.

16. A method for sensing ink quantity in an ink delivery system employed in an ink-jet printer, said ink delivery system including (1) a reservoir for storing ink, (2) a printhead adapted to propel droplets of ink to a medium, (3) a bladder means for supplying said ink to said printhead and capable of being refilled from said reservoir, and (4) means for providing selective fluid communication between said reservoir and said bladder and between said bladder and said printhead, said method comprising:

(a) providing a sensor probe comprising (1) means for moving said sensor probe into and out of contact with an upper portion of said bladder along an axis aligned with the collapse direction of said bladder, (2) means for sensing contact with said bladder surface;

(b) establishing a null reference point;

(c) filling said bladder from said reservoir;

(d) moving said sensor probe along its axis until said probe is in initial contact with the top surface of said bladder, as determined by said sensing means, and determining the position of said sensor probe with respect to said reference point;

(e) deforming said top surface of said bladder to form a dimple therein by continued movement of said probe along its axis and determining the position of said sensor probe with respect to said reference point;

(f) retracting said sensor probe from said top surface of said bladder;

(g) activating said printhead to initiate a print cycle;

(h) at the end of said print cycle, returning said probe to said top of said bladder and determining the position of said sensor probe with respect to said reference point;

(i) refilling said bladder from said reservoir;

(j) moving said probe to contact said top of said bladder and determining the position of said probe with respect to said reference point;

(k) calculating the difference between the position of said top surface before and after said print cycle; and (l) calculating the quantity of usable ink remaining at the end of said print cycle from the remaining usable ink at the beginning of said print cycle minus the volume change of said bladder as determined from a mathematical relation between volume of ink delivered and the axial displacement of said upper bladder surface.

17. A method for sensing a low ink condition in an ink delivery system employed in an ink-jet printer, said ink delivery system including (1) a reservoir for storing ink, (2) a printhead adapted to propel droplets of ink to a medium, (3) a bladder means for supplying said ink to said printhead and capable of being refilled from said reservoir, and (4) means for providing selective fluid communication between said reservoir and said bladder and between said bladder and said printhead, said method comprising:

(a) providing a sensor probe comprising
  (1) means for moving said sensor probe into and out of contact with an upper portion of said bladder along an axis aligned with the collapse direction of said bladder,
  (2) means for sensing contact with said bladder surface;
(b) establishing a null reference point;
(c) filling said bladder from said reservoir;
(d) moving said probe along its axis until said probe is in initial contact with the top surface of said bladder, as determined by said sensing means, and determining the position of said sensor probe with respect to said reference point;
(e) deforming said top surface of said bladder to form a dimple therein by continued movement of said probe along its axis and determining the position of said sensor probe with respect to said reference point;
(f) retracting said sensor probe from said top surface of said bladder;
(g) activating said printhead to initiate a print cycle;
(h) at the end of said print cycle, retuning said probe to said top of said bladder and determining the position of said sensor probe with respect to said reference point;
(i) refilling said bladder from said reservoir;
(j) moving said probe to contact said top of said bladder and determining the position of said probe with respect to said reference point;
(k) comparing the value of position at the end of said refill cycle "Z" with that derived from a previous cycle "Z3" to determine a difference $D=Z-Z3$ and comparing the value of position at the end of said refill cycle with the value derived from deformation of said top of said bladder and noting whether:
  (1) $-e<D<e$, where e is a constant representing a tolerance value on the repeatability of measurements, in which case said bladder is completely refilled and ready for a new print cycle,
  (2) $D<(Z1-Z3)$, where Z3 is the value of position at the end of said refill cycle determined from previous measurements and Z1 is the value of position after said deformation of said top of said bladder, in which case there is a low ink condition, but the print cycle can continue to completion, or
  (3) $D>(Z1-Z3)$, in which case said bladder cannot begin a print cycle with a full usable charge, and thus an out-of-ink situation is detected and said print cycle is aborted.

* * * * *